US006543438B1

(12) United States Patent
Roetken et al.

(10) Patent No.: US 6,543,438 B1
(45) **Date of Patent: *Apr. 8, 2003**

(54) FURNACE WITH DUAL USE INDUCER MOTOR

(75) Inventors: Richard L. Roetken; William J. Roy, both of Plainfield; Ninev Karl Zia, Indianapolis, all of IN (US)

(73) Assignee: Carrier Corporation, Syracuse, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/811,230

(22) Filed: Mar. 3, 1997

(51) Int. Cl.[7] ..... F24H 3/02
(52) U.S. Cl. ..... 126/110 R; 126/116 R; 431/20
(58) Field of Search ..... 126/110 R, 116 R; 431/20

(56) References Cited

U.S. PATENT DOCUMENTS 4,334,855 A * 6/1982 Nelson ..... 126/116 A
4,558,689 A * 12/1985 McCann ..... 126/110 R
4,729,207 A * 3/1988 Dempsey et al. ..... 126/110 R
4,962,749 A * 10/1990 Dempsey et al. ..... 126/110 R
5,027,789 A * 7/1991 Lynch ..... 126/116 A
5,601,071 A * 2/1997 Carr et al. ..... 126/110 R
5,732,691 A * 3/1998 Maiello et al. ..... 126/110 R

* cited by examiner

*Primary Examiner*—Henry Bennett
*Assistant Examiner*—Josiah C. Cocks

(57) ABSTRACT

An improved furnace including a two-speed inducer motor which can be used as a single speed motor for either a vertically or horizontally vented furnaces. The inducer has a common terminal, a low speed terminal and a high speed terminal. One lead is attached to the common terminal and, depending on whether the furnace is vented horizontally or vertically, either the high speed or low speed terminal is used. If the furnace is vented vertically, one lead is connected to the common terminal and the other lead is connected to the low speed terminal. Thus the furnace operates at a low speed when the furnace is vented vertically. If the furnace is vented horizontally, one lead is connected to the common terminal and the other lead is connected to the high speed terminal. Thus, the inducer motor operates at the higher speed when the furnace is vented horizontally.

3 Claims, 3 Drawing Sheets

FURNACE WITH DUAL USE INDUCER MOTOR

BACKGROUND OF THE INVENTION

1. Field of the Invention

This invention relates in general to a furnace with a dual use inducer motor. More particularly, the invention relates to an improved furnace which allows for an inducer motor to operate at the proper speed for a furnace that is vented either vertically or horizontally.

2. Discussion of the Related Art

In conventional gas-fired forced air furnaces a thermostat senses the temperature in the comfort zone relative to a predetermined set point temperature. When the temperature is below the set point, the thermostat closes to supply thermostat ac power to the furnace as a call for heat. This initiates a sequence of events that ultimately causes the furnace to come on. An inducer motor is enabled to flow air through the heat exchangers for combustion, after which a gas valve is actuated to supply gas to the gas burners. An ignition device is also actuated to light the burners. A flame sensor then proves burner ignition. Then, after a predetermined blower delay time, which varies with furnace design, the furnace blower is actuated. The blower circulates room air from the return air duct over the furnace heat exchangers to pick up heat from the hot combustion products (carbon dioxide, nitrogen, oxygen, and water vapor). The heated circulating air then goes into the supply air plenum and is distributed by ductwork back to the living space. When the living space is warmed sufficiently to reach the thermostat set point, the thermostat terminates the call for heat. When this happens, the blower and burners go through a shut off sequence and the furnace awaits the next call for heat.

After passing through the heat exchanger, the combustion byproducts are vented outside of the structure through a vent pipe. The vent pipe can be oriented either predominantly horizontally through a side wall of the structure or predominantly vertically through the roof of the structure. When the inducer motor is in operation, a substantial step-up in pressure occurs between the intake of the inducer housing (the collector box) on the one hand, and the outflow of the inducer housing (the relief box) on the other hand. Typically there is negative pressure (relative to atmospheric pressure) at the intake. The pressure at the outlet of the inducer housing is slightly negative for conventional vertical vent systems, and substantially positive for horizontal side vent systems. A horizontally vented furnace is affected by wind conditions such that under certain outside conditions, such as high wind conditions, back pressure can cause the inducer to become overloaded. However, a vertically vented furnace is not affected as much by wind conditions because the buoyancy of the heated air and the angle of incidence of wind on the vent termination. In order to avoid a decrease in pressure drop across the inducer caused by wind in a horizontally vented furnace, the inducer system must be strong enough to overcome the back pressure.

Prior to the time the furnace is installed, it is not known whether the furnace will be vented horizontally or vertically. Therefore, in the past, in order to provide an adequately strong inducer motor, the motor would have to be sized for horizontal venting. If the furnace was installed with vertical venting, the motor would be oversized. An oversized inducer motor results in decreased efficiency and increased noise.

Recently, loopholes in the ANSI wind test for furnaces which many furnace manufacturers exploited to avoid the need for a stronger inducer system, have been closed. This further emphasizes two discrete operating regimes for vertical and horizontal venting. A stronger inducer system is now required to meet the revised standards. When this stronger motor is used in a vertically vented furnace, the loss of efficiency and increase in noise become highly undesirable. As furnace manufacturers submit new designs for certification under the revised test standards, inducer systems will be revised to produce greater overall capacity. These manufacturers will be manufacturing furnaces with inducer systems which, when vented vertically, will be greatly oversized. The present invention provides a solution to the problem of using an oversized motor in a vertically vented furnace.

SUMMARY OF THE INVENTION

An apparatus is provided for improving the efficiency and reducing the noise of a furnace. The present invention provides a two speed inducer motor which can be used as a single speed inducer for either a vertically or horizontally vented furnace. The inducer has a common terminal, a low speed terminal and a high speed terminal. In conventional two-speed furnace inducer systems, one lead is attached to each of the three terminals and the control automatically selects a speed. However, in the present invention, one lead is attached to the common terminal and, depending on whether the furnace is vented horizontally or vertically, either the high speed or low speed terminal is used. If the furnace is vented vertically, one lead is connected to the common terminal and the other lead is connected to the low speed terminal. Thus, the inducer system operates at a low speed when the furnace is vented vertically. If the furnace is vented horizontally, one lead is connected to the common terminal and the other lead is connected to the high speed terminal. Thus, the inducer system operates at the higher speed when the furnace is vented horizontally. This design approach allows, as a further benefit, the avoidance of cost associated with systems available from manufacturers with two-speed/two-stage furnaces.

These and other details, advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF A PREFERRED EMBODIMENT

Figure 1:
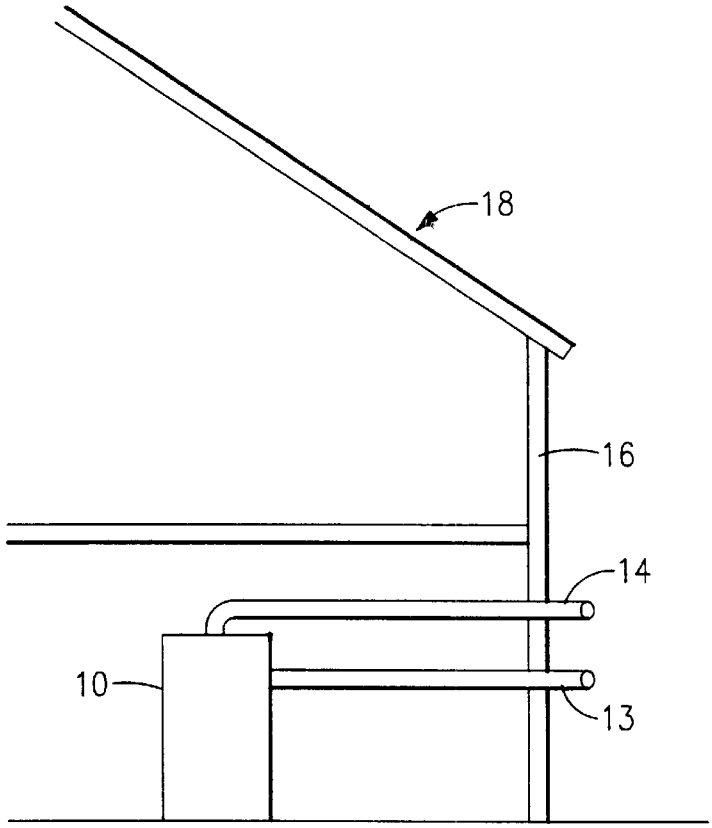
FIG. 1 is a diagrammatic view of a furnace having horizontal air intake and venting.
Figure 2:
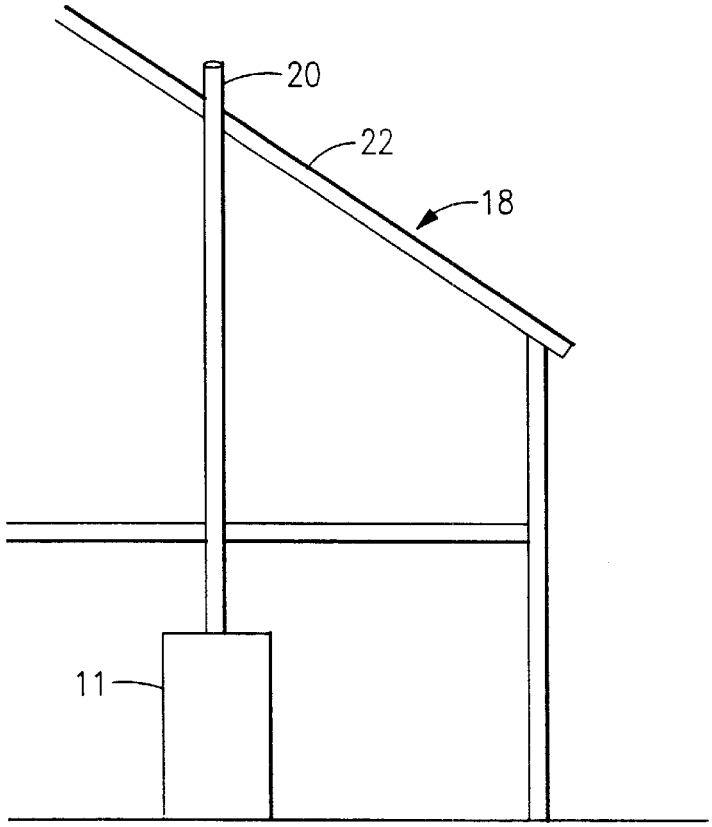
FIG. 2 is a diagrammatic view of a furnace having vertical venting.
Figure 3:
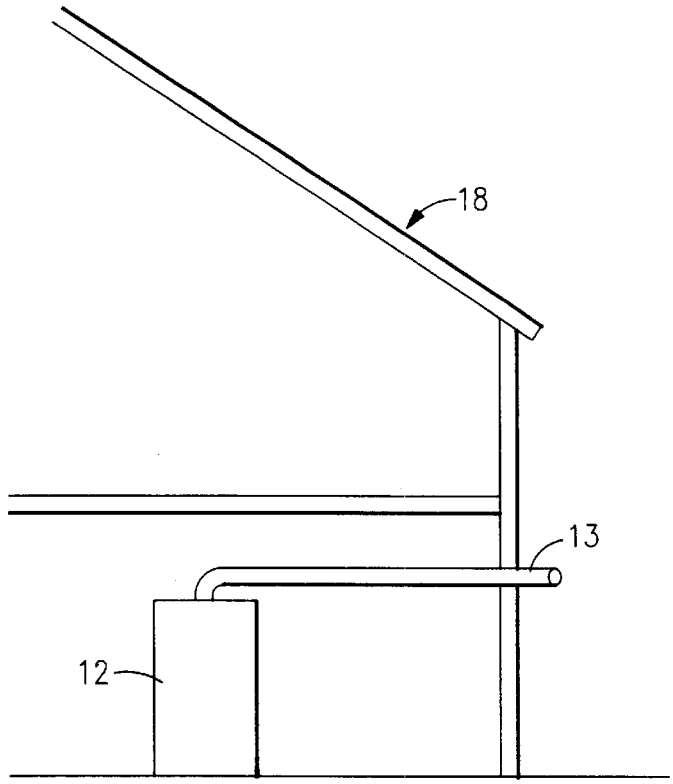
FIG. 3 is a diagrammatic view of a furnace having horizontal venting.

Referring now to the drawings, which are for the purpose of illustrating the preferred embodiment of the invention and not for the purpose of limiting the same, FIGS. 1–6 show the furnace with the two speed inducer 50 of the present invention. FIGS. 1–3 show three venting methods for the furnace. FIG. 1 shows the furnace 10 with a horizontal vent 13 and a horizontal air intake 14. The vent and air intake 14 project through a side wall 16 of a structure 18. Such venting, called direct venting, is unaffected by wind conditions because an increase in wind at the vent 13 is cancelled out by an equal increase in wind at the air intake 14. FIG. 2 shows a furnace 11 with a vertical vent 20 through the roof 22 of the structure 18. The furnace 11 takes combustion air from inside the structure 18 and does not have an external air intake as with the furnace 10 in FIG. 1. FIG. 3 shows a furnace 12 with a horizontal vent 13. As with the furnace 11 in FIG. 2, the furnace 12 of FIG. 3 takes in combustion air from inside the structure 18 and does not have an external air intake.

Figure 6:
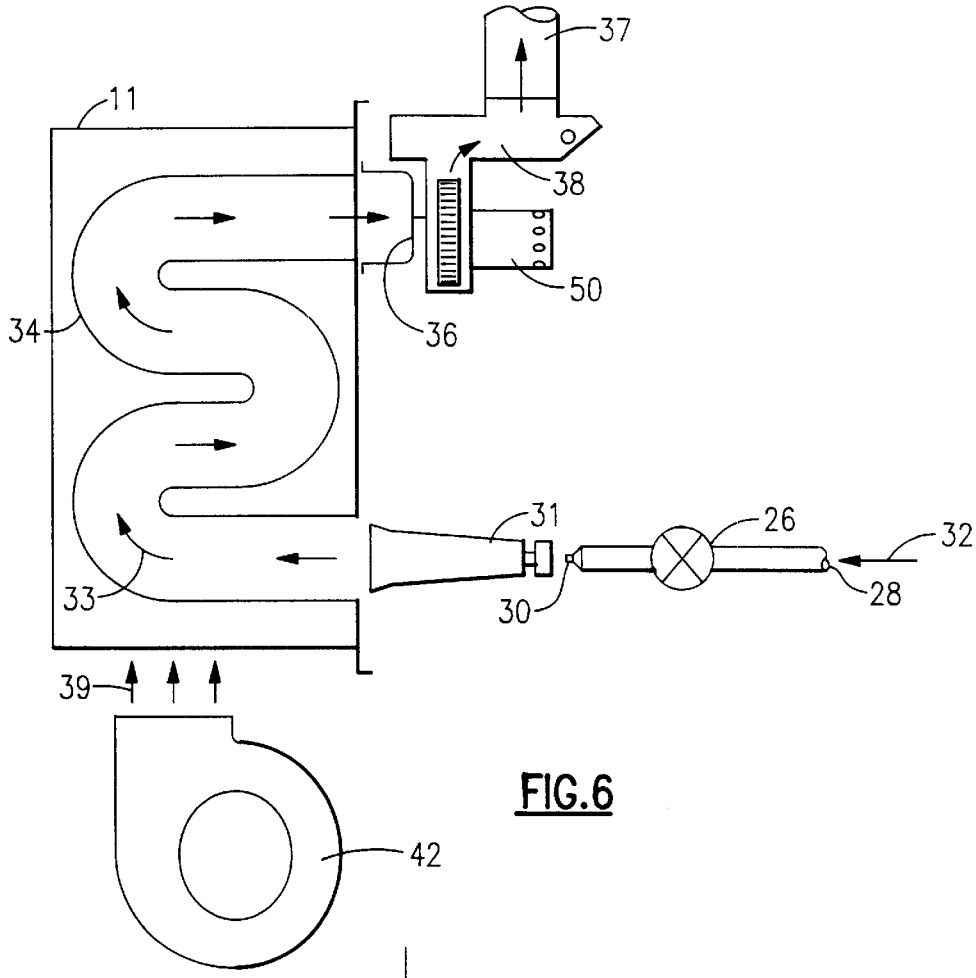
FIG. 6 is a diagrammatic view of a furnace.

The furnace can be any conventional gas fired furnace. As shown in FIG. 6, the furnace 11 includes a gas valve 26 which receives gas from an external source. The gas valve 26 includes an inlet port 28 and an outlet port 30. Gas, represented by arrows 32, flows through the valve 26 and outlet port 30 to the burners 31. The gas is ignited in the burners 31 and produces hot combustion products, represented by the arrows 33. The hot combustion products 33 are drawn through heat exchangers 34 by the inducer 50. The inducer 50 has an inlet 36 and an outlet 38. The hot combustion products 33 then pass through the vent pipe 37 to the outside. Room air, represented by arrows 39 is forced over the heat exchangers 34 by the blower 42. The room air 39 passes over the heat exchangers 34 to pick up heat from the heat exchangers 34 to warm the room air 39.

Figure 4:
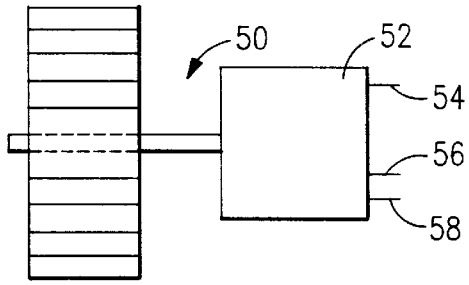
FIG. 4 is a diagrammatic view of a two speed inducer motor.
Figure 5:
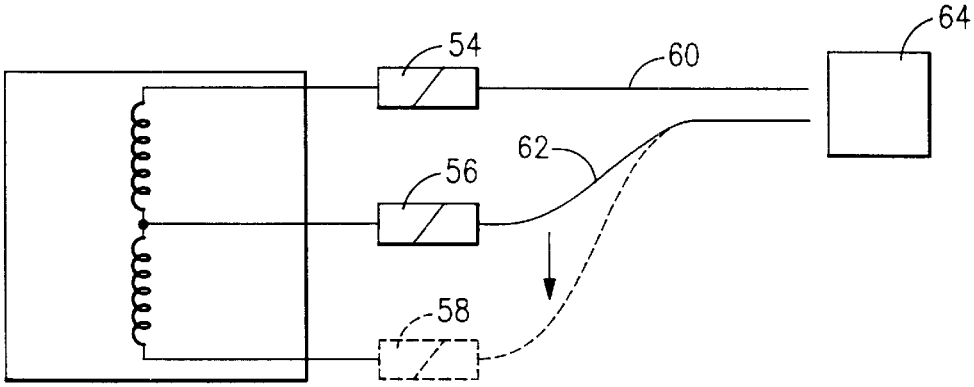
FIG. 5 is a schematic of the inducer motor of FIG. 4.

Referring to FIGS. 4 and 5, the inducer 50 includes a motor 52 capable of operating a two speeds, a low speed and a high speed. The inducer motor 52 has a common terminal 54, a low speed terminal 56 and a high speed terminal 58. A first wire 60 is connected to the common terminal 54. A second wire 62 is connected to either the low speed terminal 56 or the high speed terminal 58. Electrical current is sent through or by the furnace control during heating mode sequence of operations 64 through the wires 60 and 62 to energize the inducer motor 52. When the wire 62 is connected to the low speed terminal 56, the inducer motor 52 operates at low speed. When the wire 62 is connected to the high speed terminal 58, the motor 52 operates at high speed.

When the furnace is installed, the installer will either vent the furnace horizontally (FIG. 3) or vertically (FIG. 2). The horizontal venting is affected by wind conditions to a greater degree than the vertical venting. Currently, manufacturers supplying furnaces that in both orientations either do not meet the latest revisions to the wind test standard, or utilize a single-speed inducer system that is sufficiently sized for the wind effects of horizontal venting. When the high speed motor was used for the vertically vented furnace, a loss of efficiency resulted because the inducer system produced greater combustion air flow across the burners than was necessary. The present invention allows a two-speed inducer motor to be used as a single-speed motor. The inducer speed is permanently selected based upon whether the furnace is vented vertically or horizontally. If the furnace is installed with a vertical vent (FIG. 2), wire 62 is connected to the low speed terminal 56. If the furnace is installed with a horizontal vent (FIG. 3), wire 62 is connected to the high speed terminal 58. This allows a single motor to be provided with the furnace so that the furnace will operate efficiently when installed with either a horizontal or vertical vent.

Figure 7:
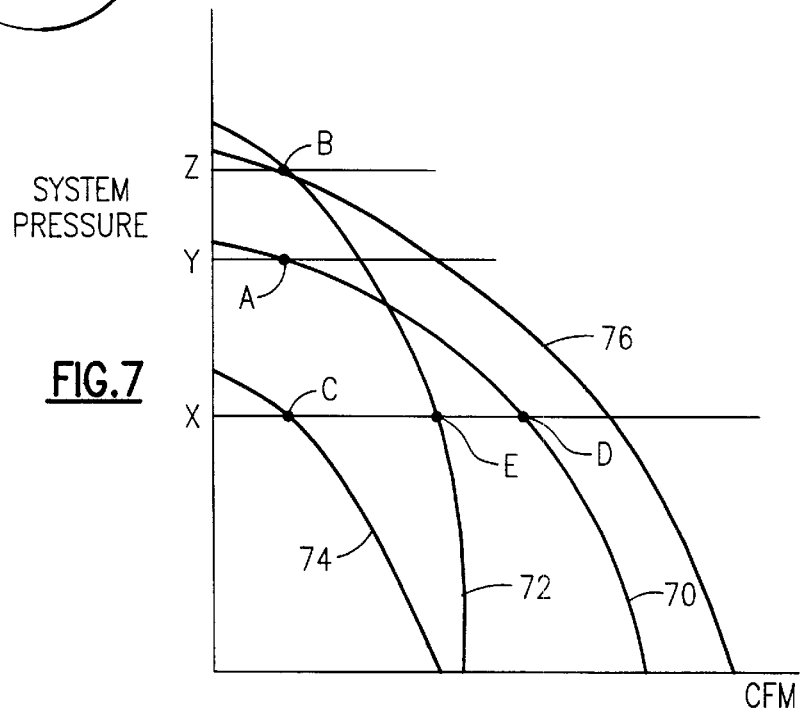
FIG. 7 is a graphical representation showing system pressure generated by an inducer motor as a function of air flow (cubic feet per minute).

FIG. 7 shows the relative relationship between system pressure generated by the inducer system and the output of the inducer system in cubic feet per minute for current furnace systems, furnace systems designed to meet the recent revisions to the ANSI wind test method using a single speed inducer motor and a furnace designed in accordance with the present invention. Curve 70 shows the relationship between system pressure and output of a furnace which complies with the original ANSI test method. Curve 72 shows the relationship between the system pressure and output of a single speed motor which will meet the revised ANSI test method. Curves 74 and 76 show the relationship between system pressure and output of the two speed inducer motor of the present invention operated at the low speed (74) for vertically vented furnaces and at the high speed (76) for horizontally vented furnaces. System pressure X represents the pressure needed to operate the furnace with a vertical vent. System pressure Y represents the pressure needed to meet the original ANSI test method for a horizontally vented furnace. System pressure Z represents the pressure needed to comply with the revised ANSI test method for a horizontally vented furnace. Point A on curve 70 shows the inducer motor output needed to generate sufficient system pressure under the original ANSI test method. While this system pressure will be appropriate for horizontally vented furnaces, it is much higher than is needed to operate in a vertically vented furnace (pressure X). Thus, the inducer motor in a vertically vented furnace will have to operate at a much higher flow rate than is necessary. Point B on both curves 72 and 76 shows the inducer system output needed to generate sufficient system pressure under the revised ANSI test method. This system pressure is much higher than is necessary for a vertically vented furnace. Point C on curve 74 shows the inducer motor of the present invention operating in the low speed. The system pressure X is achieved at a lower output than with a one speed motor operating under either the original ANSI test method (point D) or the new ANSI standards (point E).

While this invention has been described in detail with reference to a preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. An apparatus for heating an enclosure, comprising:

a furnace adapted to deliver heated air to the enclosure and to deliver combustion products outside of the enclosure having a two speed inducer motor, said two speed inducer motor having a common terminal, a low speed terminal and a high speed terminal;

a vent pipe connected to said furnace and adapted for venting said combustion products of the furnace, said vent pipe to be installed in one of two positions, a substantially vertical position and a substantially horizontal position;

a control system adapted to provide electrical power to said inducer motor;

a first wire in electrical communication with said control system and said common terminal;

a second wire in electrical communication with said control system and one of said low speed terminal and said high speed terminal, said second wire connected only to said low speed terminal when said vent pipe is installed in said vertical position and said second wire connected only to said high speed terminal when said vent pipe is installed in said horizontal position such that the inducer motor operates at all times at one speed, with the other speed not being used.

2. A method for heating an enclosure comprising the steps of:

providing a furnace adapted to heat the enclosure, said furnace having a two speed inducer motor with a common terminal, a low speed terminal and a high speed terminal;

venting combustion byproducts from the furnace through a vent pipe in one of two orientations, a first orientation in which said vent pipe is substantially vertical and a second orientation in which said vent pipe is substantially horizontal;

providing electrical power to said common terminal and only to said low speed terminal at all times when said vent pipe is in said first orientation and to said common terminal and only to said high speed terminal at all times when said vent pipe is in said second orientation such that the inducer motor operates at all times at one speed, with the other speed not being used.

3. A method for heating an enclosure comprising the steps of:

providing a furnace adapted to heat the enclosure, said furnace having a two speed inducer motor with a common terminal, a low speed terminal and a high speed terminal;

venting combustion byproducts from the furnace through a vent pipe in one of two orientations, a first orientation in which said vent pipe is substantially vertical and a second orientation in which said vent pipe is substantially horizontal;

providing electrical power to said inducer motor through a first electrical wire attached to said common terminal and through a second wire, said second wire attached only to said low speed terminal at all times when said vent pipe is in said first orientation and said second wire attached only to said high speed terminal at all times when said vent pipe is in said second orientation such that the inducer motor operates at all times at one speed, with the other speed not being used.

* * * * *